US005269650A

United States Patent [19]

Benson

[11] Patent Number: 5,269,650

[45] Date of Patent: Dec. 14, 1993

[54] UNIFORM FLOW EXHAUST GAS TRANSFER PIPE

[76] Inventor: Steven R. Benson, 5919 S. 350 West, Murray, Utah 84107

[21] Appl. No.: 961,669

[22] Filed: Oct. 16, 1992

[51] Int. Cl.[5] ..... F01D 1/00

[52] U.S. Cl. ..... 415/182.1; 138/109; 138/177; 138/178; 138/DIG. 8; 138/DIG. 11; 285/9.2

[58] Field of Search ..... 415/182.1; 60/322, 280; 285/9.2, 261, 175, 233; 138/DIG. 11, DIG. 8, 177, 178, 109

[56] References Cited

U.S. PATENT DOCUMENTS

| | | | |
|---|---|---|---|
| 2,175,191 | 10/1939 | Goyette | 285/261 |
| 2,206,414 | 7/1940 | Markey . | |
| 2,261,912 | 11/1941 | Buente | 138/DIG. 8 |
| 2,305,295 | 12/1942 | Lang et al. . | |
| 2,774,618 | 12/1956 | Alderson . | |
| 3,068,638 | 12/1962 | Birmann . | |
| 3,218,029 | 11/1965 | Woollenweber, Jr. . | |
| 3,673,798 | 7/1972 | Kuehl . | |
| 4,054,306 | 10/1977 | Sadoff, Jr. et al. | 285/233 |
| 4,158,586 | 6/1979 | Usui | 138/DIG. 8 |
| 4,294,973 | 10/1981 | Neff | 60/597 |
| 4,373,329 | 2/1983 | Martini | 60/305 |
| 4,410,281 | 10/1983 | Crookes | 138/DIG. 11 |
| 4,503,680 | 3/1985 | Wood | 60/605 |
| 4,512,716 | 4/1985 | McHenry et al. . | |
| 4,514,986 | 5/1985 | Benson | 60/605 |
| 4,530,526 | 7/1985 | Dopyera et al. | 285/261 |
| 4,744,695 | 5/1988 | Lindsey et al. | 138/177 |
| 4,850,797 | 7/1989 | Benson | 415/205 |
| 4,917,408 | 4/1990 | Vidrine et al. | 285/261 |
| 4,998,754 | 3/1991 | Matsumoto et al. | 138/DIG. 11 |

*Primary Examiner*—John T. Kwon
*Attorney, Agent, or Firm*—M. Reid Russell

[57] ABSTRACT

The invention is in a transfer pipe for passing engine exhaust gas from an engine exhaust manifold to a turbine inlet side of an exhaust gas driven turbine air compressor. The transfer pipe is formed from a material, such as steel, that is appropriate for use in transferring hot engine exhaust gas and provides for mounting on one end across the turbine inlet The opposite transfer pipe end is arranged for fitting into an open collar end of an exhaust gas conduit that receives exhaust gas from the engine exhaust manifold, and includes a circumferential arcuate section for providing a metal to metal seal with the collar interior wall while allowing the transfer pipe to be tilted relative to the collar interior wall without breaking the seal. The transfer pipe provides a uniform cross sectional area along its length and is widened through a uniform arc at bends to maintain that uniform cross section along the entire pipe length, minimizing creation of turbulence in the gas flow as would occur at a point where the pipe is narrowed and then expands.

5 Claims, 3 Drawing Sheets

UNIFORM FLOW EXHAUST GAS TRANSFER PIPE

BACKGROUND OF THE INVENTION

1. Field of the Invention

This invention relates to tubes and pipes for transferring vehicle engine exhaust to an inlet side of an exhaust gas driven turbine air compressor.

2. Prior Art

Pipes formed to have a constant diameter and cross section along their length with ends for coupling, respectively, to a vehicle exhaust manifold and the inlet side of an exhaust gas driven turbine air compressor are, of course, well known and commonly used. Such pipes to fit within the engine compartment and over the engine are often bent, changing the pipe cross section and thereby effecting the exhaust gas flow therethrough. Specifically, with a change in pipe cross section, as results from bending the pipe, the gas velocity through that bent section may be changed, resulting in a change in gas flow velocity through the bend and downstream creating turbulence in the gas flow that enters the turbine inlet. As for example, where the area of the pipe cross section at the bend is less than that of the pipe downstream from which bend, the gas flow will speed up at the bend and slow down after the bend creating turbulence. Unlike such earlier exhaust gas transfer pipes, the present invention provides for widening the pipe or otherwise reforming the pipe cross section at such bend, to have a uniform transition and, present a uniform cross sectional area along the entire pipe length. A uniform none turbulent exhaust gas flow is thereby provided that enters the inlet of the exhaust gas driven turbine air compressor.

Earlier arrangements for providing a smooth flow transition to a from an exhaust gas driven turbine air compressor have been developed and marketed by the present inventor as set out in a U. S. Pat. No. 4,850,797. This patent, however, is directed to a turbine housing and connected exhaust and inlet chamber, but like the pipe of the invention, does employ a telescoping end coupling. A double chambered manifold system for coupling between an engine manifold and inlet and outlet sides of an exhaust gas driven turbine air compressor is shown in another patent of the present inventor, U.S. Pat. No. 4,514,986. Which manifold system, however, does not involve an exhaust gas transfer tube or pipe like that of the invention.

Additional to the turbine housing of the '797 patent of the present inventor, a number of other turbine housings alone and with connecting pipes have been developed. Examples of such turbine housings are shown in patents to Lang, et al, U.S. Pat. No. 2,305,295; to Birmann, U.S. Pat. No. 3,068,638; to Kuehl, U.S., Pat. No. 3,673,798; and to McHenry, et al, U.S. Pat. No. 4,512,716. With examples of earlier turbine housings and connecting tubes or pipes shown in patents to Woollenweber, Jr., U.S. Pat. No. 3,218,029; to Neff, U.S. Pat. No. 4,294,073; to Martini, U.S. Pat. No. 4,373,329; and to Wood, U.S. Pat. No. 4,503,680. Neither the turbine housing or turbine housing and connecting tubes or pipes arrangements of which above patents, however, involve appropriately fabricating a transfer pipe to have a cross sectional area across a bend that provides a uniform transition and maintains a uniform cross sectional area along the length of the transfer pipe to maintain a uniform non-turbulent exhaust gas flow to an inlet side of a turbine compressor.

Additionally, the pipe of the invention involves a quick connection coupling on one end thereof. Such fittings are not new, and a similar arrangement is shown in the above set out earlier '797 patent of the inventor. With coupling arrangements also shown in patents to Markey, U.S. Pat. No. 2,206,414; and to Alderson, U.S. Pat. No. 2,774,618. None of which pipe end couplings, however, are components of a tube or pipe that is like that of the present invention for providing a non-turbulent exhaust gas flow into the inlet side of an exhaust gas driven turbine air compressor.

SUMMARY OF THE INVENTION

It is a principal object of the present invention to provide a uniform flow exhaust gas transfer pipe where the pipe cross section is widened at a bend to maintain a uniform cross sectional area along its entire length for providing a non-turbulent exhaust gas flow from a vehicle exhaust system into the inlet side of an exhaust gas driven turbine air compressor.

Another object of the present invention is to provide a uniform flow exhaust gas transfer pipe that is formed with a uniform curve through the pipe bend for providing a non-turbulent exhaust gas flow from a vehicle exhaust system into the inlet side of an exhaust gas driven turbine air compressor.

Another object of the present invention is to provide a telescoping connectorless coupling arrangement with the transfer pipe of the invention where a coupling end of the transfer pipe is fitted into an exhaust gas transfer conduit collar coupling for providing a metal to metal sealed joint that allows for movement of the transfer pipe relative to the conduit coupling, and presents a nearly seamless joint for minimizing a disruption of exhaust gas flow across which joint.

Still another object of the present invention is to provide an exhaust gas transfer pipe that is manufactured and bent to closely conform to a specific vehicle engine system, and is formed, at which bend of bends, to provide a uniform cross sectional area along the tube length so as to provide an undisrupted non-turbulent exhaust gas flow therethrough.

Still another object of the present invention is to provide an exhaust gas transfer pipe that is easily and quickly installed.

In accordance with the above objects the present invention in an exhaust gas transfer pipe and coupling arrangement includes a pipe that is bent, as needed, through a uniform arc to closely fit across a specific vehicle engine configuration, between a vehicle exhaust conduit arrangement and the inlet side of an exhaust gas driven turbine air compressor. Further, the transfer pipe is appropriately enlarged at its bend or bends so as to maintain a uniform cross sectional area along the entire pipe length and through each bend or bends, so as to minimize a flow disruption as could create turbulence in an exhaust gas flow passing therethrough. The transfer pipe incorporates a standard rectangular plate coupling for mounting its exhaust end to the inlet side of the turbine air compressor, and a connectorless telescoping coupling on its opposite end. The telescoping coupling is for fitting into so as to provide a metal to metal joint with a collar mount that is secured to the vehicle exhaust gas conduit wherein the exhaust gas from the vehicle exhaust manifold or manifolds is collected. The telescoping coupling provides a smooth essentially seamless surface at the joint between the interior surfaces of the transfer pipe and vehicle conduit mount, minimizing a disruption of an exhaust gas flow thereacross.

THE DRAWINGS

The following drawings illustrate that which is presently regarded as the best mode for carrying out the invention:

DETAILED DESCRIPTION

Figure 1:
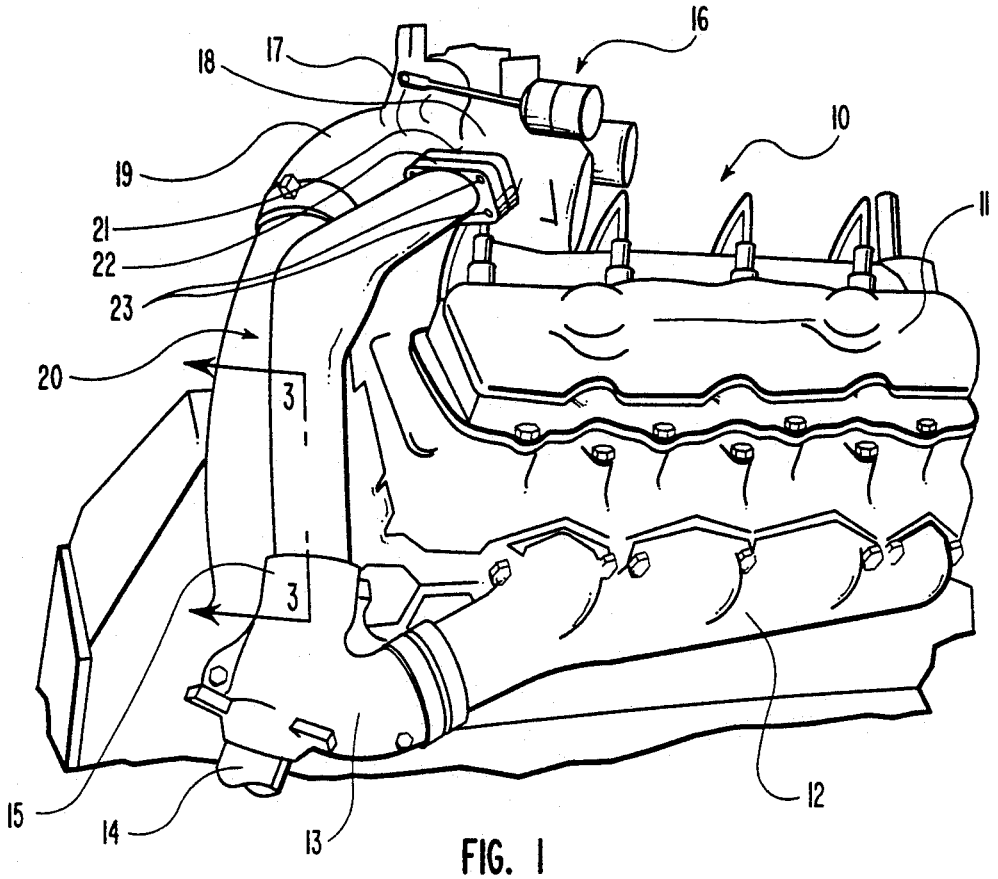
FIG. 1 is a front elevation perspective view of a vehicle engine showing a uniform flow exhaust gas transfer pipe of the invention mounted to a forward end thereof.
Figure 2:
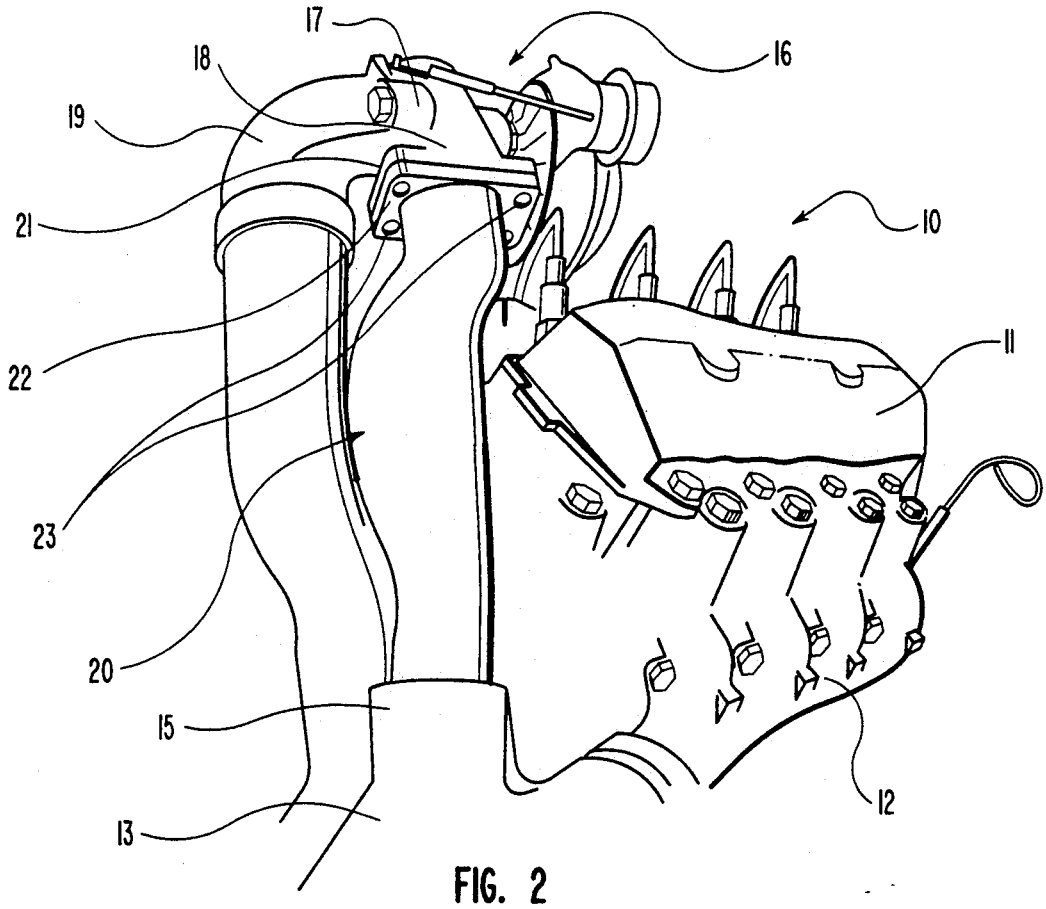
FIG. 2 is a forward end elevation perspective view of the vehicle engine and the uniform flow exhaust gas transfer pipe of FIG. 1.

FIGS. 1 and 2 show a conventional internal combustion engine 10, hereinafter referred to as engine, showing a bank of four (4) cylinders arranged on one engine side that is covered by a valve cover. The engine 10 is shown as mounting an exhaust gas manifold 12 that receives exhaust gas exhausted from the exhaust valves of which cylinders. The exhaust gas manifold 12 connects into an exhaust gas conduit 13 that is linked by a pipe 14 to receive exhaust gas from the other side of the engine 10. Exhaust gas from both engine sides is accordingly combined in the exhaust gas conduit 13 that includes a coupling collar 15. Which coupling collar 15 and its arrangement with an end of a uniform flow exhaust gas transfer pipe 20 of the invention, hereinafter referred to as transfer pipe, will be set out in detail hereinbelow with respect to a discussion of FIG. 3.

Figure 4:
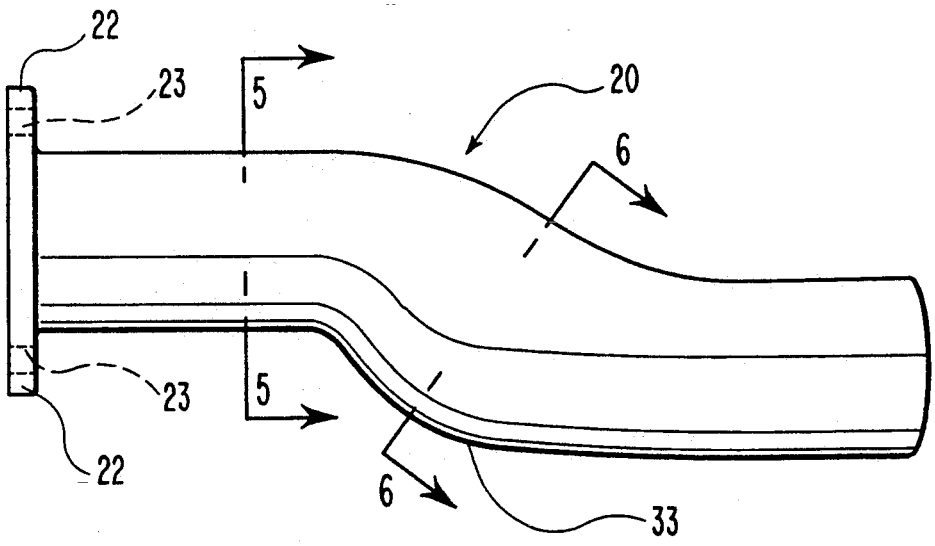
FIG. 4 is a side elevation view of the uniform flow exhaust gas transfer pipe removed from its mountings to an exhaust gas driven turbine air compressor and the vehicle exhaust gas conduit.

Shown in FIGS. 1 and 2, the engine 10 incorporates an exhaust gas driven turbine air compressor 16 that includes turbine housing 17 that has an inlet side coupling end 18 and outlet side coupling end 19. The transfer pipe 20 is for conveying engine 10 exhaust gas into the inlet side 18 of the turbine housing 17, turning an impeller therein, not shown, that turns a compressor for compressing a fresh air flow for mixing with fuel and ignition in the engine 10. It should be understood that the engine 10, the exhaust gas manifold 12, exhaust gas conduit 13, and the exhaust gas driven turbine air compressor 16, are all conventional components, and that the transfer pipe 20 of the invention is for substitution for a straight pipe, that is bent appropriately to conform to the engine profile without concern for a change in gas flow characteristics through which bend and downstream therefrom. The turbine inlet side coupling end 18 includes a rectangular plate mount 21 that is for fitting and coupling to a like rectangular plate mount 22 that is secured across the end of transfer pipe 20, that is shown best in FIG. 4. The respective rectangular plate mounts 21 and 22 each include coupling holes 23 that are formed through the corners thereof for receiving fasteners, such as bolts, not shown, fitted therethrough. Whereafter, nuts, not shown, are turned on which bolts for clamping the rectangular plate mounts 21 and 22 together.

Figure 3:
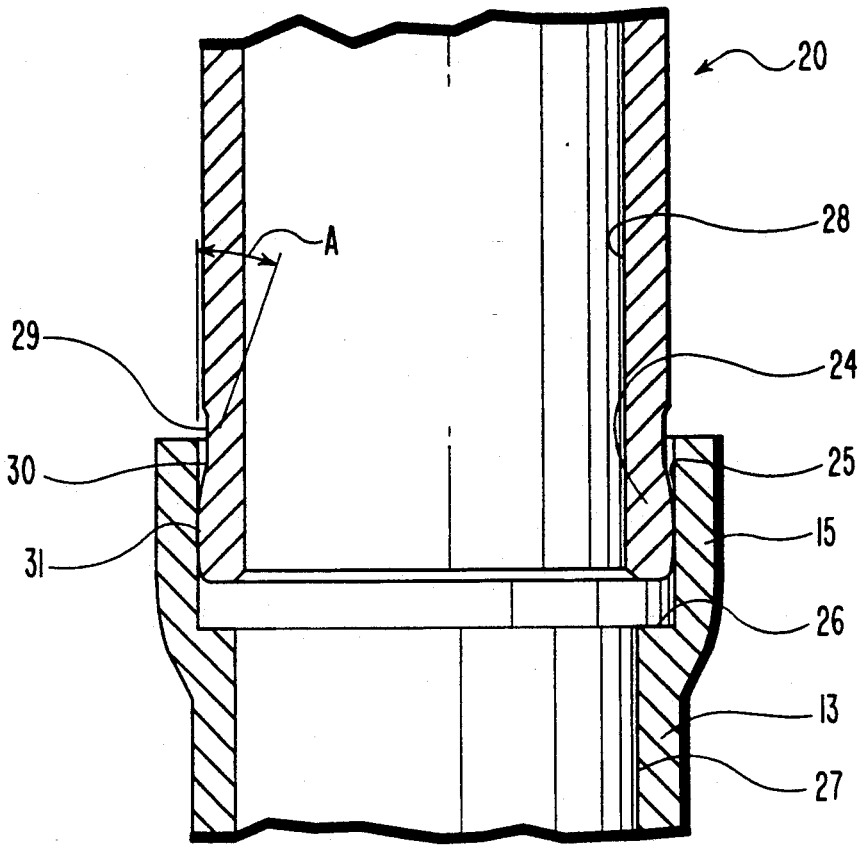
FIG. 3 is an expanded sectional view taken along the line 3—3 of FIG. 1, showing the transfer pipe end telescoped into a vehicle exhaust gas conduit collar coupling.

FIG. 3 shows a preferred arrangement for coupling the opposite transfer pipe 20 end 24 into the exhaust gas conduit 13 coupling collar 15. Which coupling collar 15, in order to receive which transfer pipe end, is flared outwardly to accept the transfer pipe end telescoped therein. Shown in FIG. 3, the inner wall 25 of which flared portion is for aligning with the outer surface of which transfer pipe. Further, for blocking travel of the transfer pipe end into which coupling collar 15, the coupling collar inner surface is stepped inwardly at 26, with the transfer pipe end 24, when fully installed, to butt against which step. With the transfer pipe end 24 fitted in the coupling collar 15, as shown in FIG. 3, the exhaust gas conduit 13 inner surface 27 will approximately align with the inner surface 28 of which transfer pipe 20, forming a straight smooth wall that is nearly seamless so as to provide for a minimum disruption in gas flow across which joint. The transfer pipe 20 is for conveying engine 10 exhaust gas from the exhaust gas conduit 13 into the exhaust gas inlet side 18 of the turbine air compressor 16. Accordingly, the coupling between which transfer pipe 20 lower end 24 with the exhaust gas conduit 13 should allow for some movement between the components both during installation and when the engine 10 is operating. To provide for some canting of the transfer pipe 20 relative to the exhaust gas conduit 13 coupling collar 15, the transfer pipe lower end 24 is tapered inwardly at 29, forming a notch around the pipe end, with the opposite end of which notch tapering outwardly, at 30, forming a rounded or arcuate section 31. For installing the transfer pipe end 24 in the exhaust gas conduit collar 15, the transfer pipe lower end 24 is telescoped into the coupling collar 15, with a point around the circumference of the rounded segment 31 for contacting the coupling collar inner surface 25 as the transfer pipe is slid therein. The circumferential point of engagement provides a metal to metal seal between the surfaces and also allows for some canting of the transfer pipe 20 relative to the coupling collar 15, illustrated as angle A, without a breach in which sealed engagement. Which angle A, in practice, is less than ten (10) degrees. The transfer pipe 20 can thereby be conveniently moved back and forth and rotated as it is fitted into the coupling collar 15, facilitating its seating and the alignment of its rectangular plate mount 22 on its top end with the turbine housing rectangular plate mount 21, for coupling which plate mounts 21 and 22 together, as set out above. In practice, it is preferred to fully seat the transfer pipe end 24 in the coupling collar 15. So arranged, the transfer pipe end surface engages the step 26 surface, for providing a minimum opening or gap therebetween, functioning, essentially, as a seamless coupling. Which seamless coupling presents a smooth surface between the components for minimizing a creation of turbulence in the engine exhaust gas flow.

Figure 5:
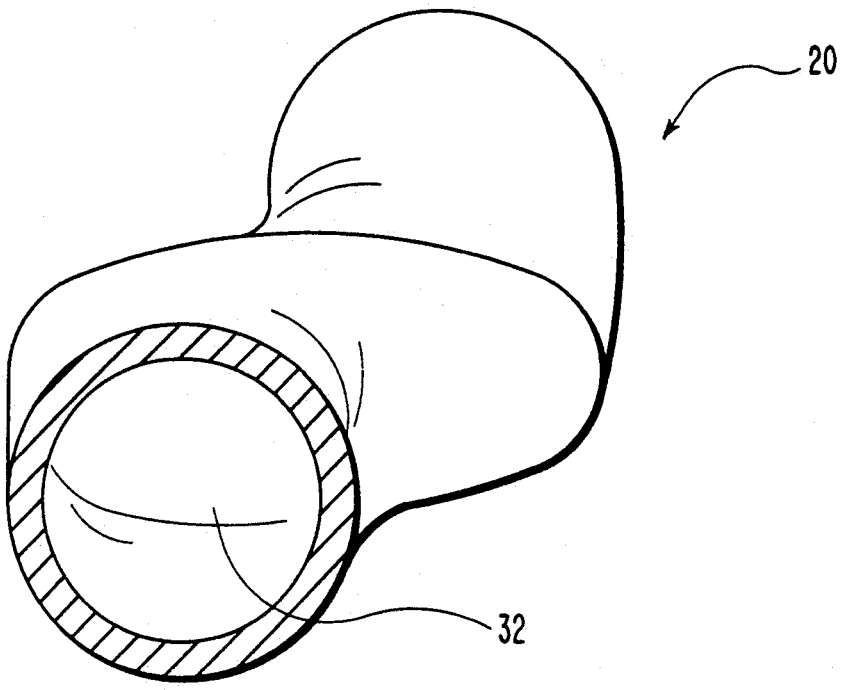
FIG. 5 is an end sectional view taken along the line 5—5 of FIG. 4 of a cross section of the transfer pipe downstream from a transfer pipe bend.
Figure 6:
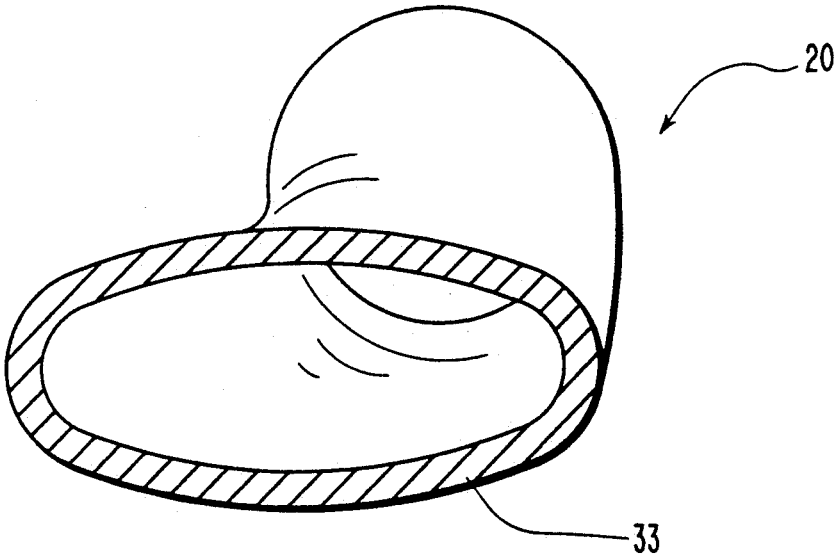
FIG. 6 is an end sectional view taken along the line 6—6 of FIG. 4 of a cross section of the transfer pipe at a transfer pipe bend.

The transfer pipe 20 is, of course, for conveying exhaust gas from the engine as has been mixed in the exhaust gas conduit 13, to the exhaust gas inlet side 17 of turbine housing 16. The transfer pipe 20 is fabricated to present a smooth essentially seamless internal surface with uniform bends and maintains a constant cross sectional area along its length so as to provide for exhaust gas passage without introduction of turbulence into that flow. To this end, as set out above, the transfer pipe end 24 is arranged for telescoping into the coupling collar 15 so as to provide essentially a smooth unbroken inner wall surface with a minimum slot or break between the transfer pipe inner surface 28 and the inner surface 27 of the exhaust gas conduit 13. The exhaust gas flow into the transfer pipe 20 is thereby minimally disrupted as it enters the transfer pipe from the exhaust gas conduit 13. For maintaining which exhaust gas non-turbulent flow condition during passage through the transfer pipe 20 the transfer pipe is curved uniformly through any bend therein, and the pipe is fabricated to present a cross sectional area at which bend that is the same as that of the transfer pipe cross sectional area along its straight portions. A constant transfer pipe cross sectional area is thereby maintained along the length of which transfer pipe 20, avoiding a pipe narrowing as would result in the flow speeding up in that narrow area and slowing down upon emerging from which narrow area. Such speeding up and slowing down of an exhaust gas flow creates turbulence in the flow that is passed into the turbine inlet, and would potentially disrupt turbine functioning. To provide such constant transfer pipe cross sectional areas along the pipe length, illustrated at 32, as shown best in FIG. 5, where the transfer pipe 20 must be bent to fit closely to the engine 10, the pipe is fabricated to increase its width at the bend 33, as shown best in FIG. 6, to compensate for a reduction in the pipe height at that bend. Without such pipe modification a bending of the pipe would result in a flattening and spreading of the pipe along which bend, diminishing the pipe cross section thereat. Whereas, as shown at 33 in FIG. 6, by increasing the pipe width as the pipe height is decreased, the same pipe cross sectional area is maintained through the bend. The transfer pipe 20 of the invention is therefore formed to have the same cross sectional area along its length, regardless of the curves or bends as are formed therein. Additionally, the bend or bends as are formed in the transfer pipe are preferably uniform in arc to provide a smooth transition to a gas flow through the bend without a creation of turbulence in that flow. Accordingly, the forming of the transfer pipe 20 to have a uniform arc bend or bends and by fabricating the pipe to have a constant cross sectional area along its length, precludes the introduction of turbulence in the exhaust gas flow traveling through which transfer pipe.

A preferred embodiment of my invention in a uniform flow exhaust gas transfer pipe and its use has been shown and described herein. It should, however, be apparent that this disclosure is made by way of example only and that variations and modifications to the transfer pipe and its use are possible within the scope of this disclosure without departing from the subject matter coming within the scope of the following claims, and a reasonable equivalency thereof, which claims I regard as my invention.

I claim:

1. A uniform flow exhaust gas transfer pipe comprising, a pipe that is open longitudinally and is formed of a suitable material for transferring hot engine exhaust gas, said pipe including coupling means on each pipe end for coupling, respectively, to a coupling of an inlet side of a turbine housing of an exhaust gas driven turbine air compressor and to an exhaust gas conduct that receives exhaust gas from an engine exhaust manifold, with said coupling means for joining said pipe end to said exhaust gas conduit consisting of a collar formed around an exhaust opening in said exhaust gas conduit, said collar for receiving an end of said pipe fitted therein, and includes a stepped section within said collar for blocking further passage of said pipe end which said pipe end is arranged to fit closely within said collar so as to provide a metal to metal seal between an arcuate circumferential section of said pipe end and said collar interior wall; and said pipe is bent at least once through a uniform arc to contour to the engine configuration, with at said bend, said pipe is formed to maintain said pipe cross sectional area, such that said pipe has a constant cross sectional area along its entire length.

2. A uniform flow exhaust gas transfer pipe as recited in claim 1, wherein the arcuate circumferential section is formed around the pipe, adjacent to its end, and alongside a groove that is formed around said pipe, above said arcuate circumferential section, said groove to receive a top edge of the exhaust gas conduit collar when said pipe is tilted relative to said collar.

3. A uniform flow exhaust gas transfer pipe as recited in claim 1, wherein the coupling means for joining the pipe end to the inlet side of the turbine housing is a rectangular plate that is open through its center, is secured across said pipe end and includes holes formed therethrough for receiving bolt type fasteners, said rectangular plate for fitting onto a like rectangular plate that is fitted across the turbine housing inlet, the holes formed through each rectangular plate aligning for receiving said bolt type fasteners fitted therethrough, for securing said rectangular plates together.

4. A uniform flow exhaust gas transfer pipe as recited in claim 1, wherein the pipe is widened at the bend to compensate for a reduction in the pipe height at that bend to maintain a pipe uniform cross sectional area across said bend.

5. A uniform flow exhaust gas transfer pipe as recited in claim 4, wherein the pipe is widened into essentially an elliptical cross section at the bend.

* * * * *